US007837006B1

(12) United States Patent
Graber

(10) Patent No.: US 7,837,006 B1
(45) Date of Patent: Nov. 23, 2010

(54) ENHANCED SPECTRUM ACOUSTIC ENERGY PROJECTION SYSTEM

(76) Inventor: Curtis E. Graber, 9301 Roberts Rd., Woodburn, IN (US) 46797

( * ) Notice: Subject to any disclaimer, the term of this patent is extended or adjusted under 35 U.S.C. 154(b) by 0 days.

(21) Appl. No.: 12/590,179

(22) Filed: Nov. 4, 2009

(51) Int. Cl.

| | |
|---|---|
| ***G10K 11/20*** | (2006.01) |
| ***G10K 11/26*** | (2006.01) |
| ***G10K 11/28*** | (2006.01) |
| ***H04R 1/34*** | (2006.01) |
| ***H04R 1/40*** | (2006.01) |
| *G10K 11/00* | (2006.01) |
| *G10K 11/18* | (2006.01) |
| *H04R 1/32* | (2006.01) |

(52) U.S. Cl. ..... 181/191; 181/176; 181/144; 381/342

(58) Field of Classification Search ..... 181/191, 181/192, 176, 152, 159, 144, 156, 155; 381/340, 381/342, 387

See application file for complete search history.

(56) References Cited

U.S. PATENT DOCUMENTS

| | | | | | |
|---|---|---|---|---|---|
| 2,642,948 | A | * | 6/1953 | Olson | 181/152 |
| 4,174,019 | A | * | 11/1979 | Kramer | 181/159 |
| 4,215,761 | A | * | 8/1980 | Andrews | 181/152 |
| 4,313,032 | A | * | 1/1982 | Thomas et al. | 381/341 |
| 4,580,655 | A | * | 4/1986 | Keele, Jr. | 181/192 |
| 4,635,749 | A | * | 1/1987 | Tattersall | 181/152 |
| 4,796,009 | A | | 1/1989 | Biersach | |
| 4,836,328 | A | | 6/1989 | Ferralli | |
| 4,923,031 | A | | 5/1990 | Carlson | |
| 5,020,630 | A | * | 6/1991 | Gunness | 181/192 |
| 5,146,508 | A | * | 9/1992 | Bader et al. | 381/342 |
| 5,285,025 | A | * | 2/1994 | Yoshioka | 181/192 |
| 5,526,456 | A | * | 6/1996 | Heinz | 381/340 |
| 5,616,892 | A | | 4/1997 | Ferralli | |
| 5,737,435 | A | * | 4/1998 | De Poortere et al. | 381/340 |
| 5,750,943 | A | | 5/1998 | Heinz | |
| 5,821,470 | A | * | 10/1998 | Meyer et al. | 181/155 |
| 6,009,182 | A | * | 12/1999 | Gunness | 381/182 |
| 6,031,920 | A | * | 2/2000 | Wiener | 381/160 |
| 6,513,622 | B1 | | 2/2003 | Gelow et al. | |
| 6,658,128 | B1 | * | 12/2003 | Yoshioka et al. | 381/340 |
| 6,950,530 | B2 | * | 9/2005 | Baird et al. | 381/343 |
| 7,268,467 | B2 | * | 9/2007 | De Vries | 310/328 |
| 7,275,621 | B1 | * | 10/2007 | Delgado, Jr. | 181/192 |
| 7,621,369 | B2 | * | 11/2009 | Graber | 181/191 |
| 2008/0121459 | A1 | * | 5/2008 | Graber | 181/155 |

* cited by examiner

*Primary Examiner*—Edgardo San Martin
(74) *Attorney, Agent, or Firm*—Paul W. O'Malley

(57) ABSTRACT

The sound generating and transmitting apparatus is based on a radiator including at least a first, and possibly two or more, shaped reflecting surface(s) having a forward radiant axis. Each of the shaped reflecting surfaces defines sets of equivalent acoustic input locations, with each set being a ring of non-zero circumference centered on the forward radiant axis. The sound source is a distributed, functionally continuous sound source adapted to exploit this feature. In its preferred form the sound source is a sort of closed line array of loudspeakers providing a torodial shaped acoustic source to direct at the hyperbolic cone, the transducers being disposed in a circle with all of the loudspeakers oriented inwardly toward or outwardly from the forward radiant axis.

8 Claims, 5 Drawing Sheets

ENHANCED SPECTRUM ACOUSTIC ENERGY PROJECTION SYSTEM

BACKGROUND

1. Technical Field

The technical field relates to directional sound systems and more particularly to a sound system for projecting a high intensity, wide spectrum sound beam, particularly in a compressible medium such as air.

2. Description of the Problem

High intensity sound beams in air have long been produced using parabolic reflectors. Meyer et al., in U.S. Pat. No. 5,821,470 described a Broadband Acoustical Transmitting System based on a parabolic reflector incorporating two loudspeaker transducers. One transducer was spaced from the reflector, forward along the intended axis of propagation of sound at the focal point of the reflector. This transducer was horn loaded and oriented to propagate sound backward along the radiant axis and into the reflector for reflection in a collimated beam. The horn loaded transducer was intended to handle the higher frequency components of the overall field. A second transducer for low frequency components was located opposed to the horn loaded transducer on the radiant axis, preferably flush mounted in the parabolic reflector and oriented for forward propagation of sound. At this location the low frequency transducer would derive relatively little benefit from the focusing aspects derived from the parabolic shape of the reflector, though the reflector would serve as a baffle.

Volume can be increased in general by using an increasing number of transducers operating on the same input signal. Generally, a simple parabolic reflector such as employed by Meyer does not readily allow the use a large number of transducers operating on the same input because of the inability to place more than one transducer at the focal point of the reflector. U.S. Pat. No. 4,796,009 to Biersach teaches a high volume sound projector where a potentially large plurality of loudspeakers or drivers are coupled to emit into a acoustical impedance chamber having a restricted output port. The output port opens into the throat of a horn.

Another technique for combining the outputs of a number of drivers is to place them in an array where the distances between loudspeakers result in the sound fields produced by the drivers produce zones of constructive and destructive interference. The resulting sound field can be shaped and steered by adjusting the phase relationship of the outputs of the transducers. Another sound reinforcement system which can accept inputs from a large plurality of transducers arranged in a line array and which employs a reflecting surface having some attributes of a parabolic dish was described in U.S. Patent Application Publication 2008/0121459 for an Acoustic Energy Projection System by the present inventor which is incorporated herein by reference. One embodiment of Publication 2008/0121459 related to a sound generation and projection apparatus based on a radiator having a conically shaped and parabolically sculpted reflecting surface. The shaped reflecting surface defined a set of equivalent acoustic input locations. The set of locations typically lay in a circle or ring centered on the radiant axis and encircling the reflecting surface just forward from its base.

The set of equivalent acoustic input locations had non-zero circumference centered on the forward radiant axis. Sound sources located acoustically "close" to one another at the acoustic locations would form a distributed sound source which operates as a continuous source below a cut off frequency. The sound source was, in effect, a curved, or even closed loop line array of loudspeakers.

Horns function as impedance matching devices, that is a type of transformer, providing a high impedance to a driver at its input end (the throat) and expanding in cross-sectional area to meet the low impedance of free air at the radiating end (mouth) of the horn. Substantial efficiency gains are possible using horns, however, horn effectiveness depends upon relating dimensions of the horn to the sound frequency spectrum to be radiated. One of these relationships is the one between the area of the mouth (usually expressed in terms of circumference of the mouth for a given mouth shape) and wavelength. For a horn having a circular cross-section the ratio of the mouth circumference to wavelength should exceed 1 for the longest wavelength in the sound spectrum to be radiated. By inference, a given horn ceases to provide any substantial impedance matching capacity to shorter wavelengths in the spectrum at some point along the horn short of the mouth. Thus horn loading the transducers of U.S. Patent Application Publication 2008/0121459 would produce efficiency gains.

However, accommodating horns in a projector of limited size becomes difficult if low acoustic frequencies are important, particularly for some flare types, due to the increasing length of the horn used to achieve most of the available gain.

SUMMARY

A sound field blending and projection apparatus combines the outputs from a plurality of acoustic drivers/transducers. The apparatus includes a radiator and a plurality of horn loaded acoustic transducers. The mouths of the horns are arranged in a radial array. The radiator includes a conical acoustic reflector centered within a radial array. The horn mouths are modified so that the radial array is effectively inwardly directed on the conical acoustic reflector in middle and upper range frequencies and effectively forward directed parallel to the radiant projection axis at lower range frequencies. The radiating end of a circular cross-section horn should have a circumference C such that the ratio of $C/\lambda>1$ where $\lambda$ is wavelength of the longest wavelength sound to be radiated. Each horn blends into the conical acoustic reflector to increase the effective mouth area for the horn for progressively longer wavelength sound and to introduce a fold to the horns for the longer wavelengths. Put another way, for middle and higher frequencies, the projector may be viewed as a multi-horn radial array with a central conical element. At lower frequencies the projector may be viewed as a multi-throated folded horn with a single mouth perpendicular to the projection axis defined by the central conical element and the speakers are ported to the throats.

BRIEF DESCRIPTION OF THE DRAWINGS

The appended claims define the novel features of a sound projector. The modes of use will best be understood by reference to the following detailed description of an illustrative embodiment when read in conjunction with the accompanying drawings, wherein:

DETAILED DESCRIPTION

Figure 1:
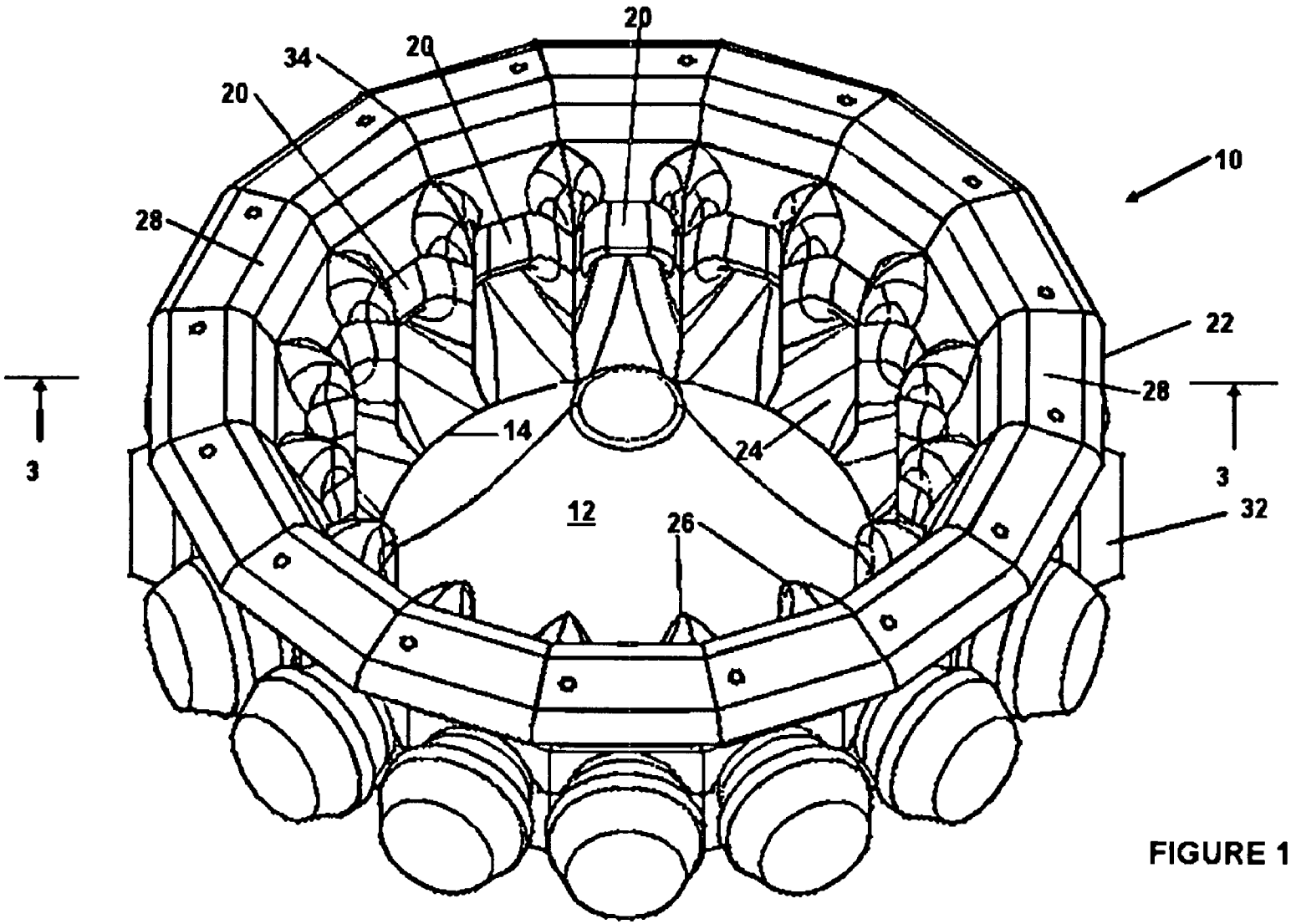
FIG. 1 is a perspective view of an embodiment of the sound projector.
Figure 2:
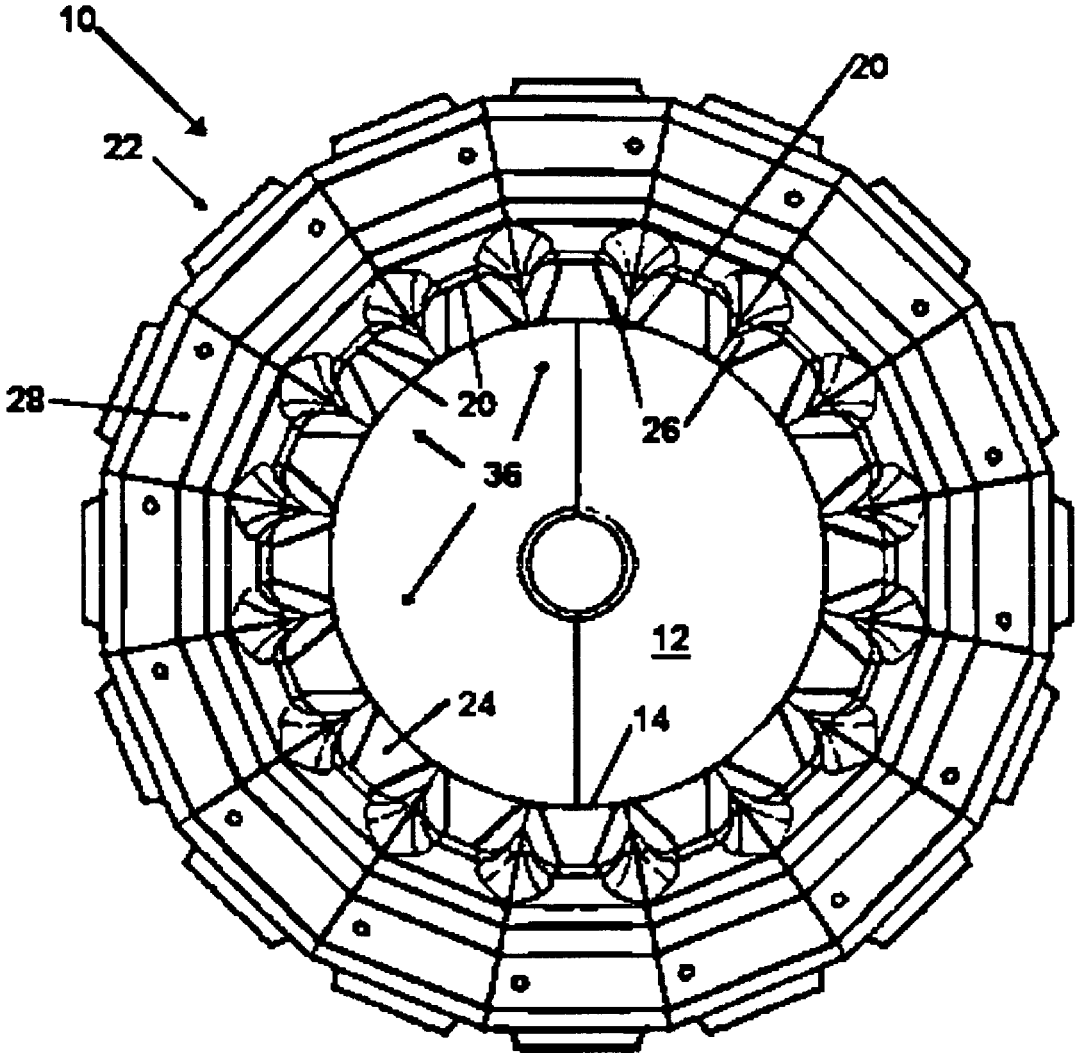
FIG. 2 is a top plan view of the embodiment of FIG. 1.
Figure 3:
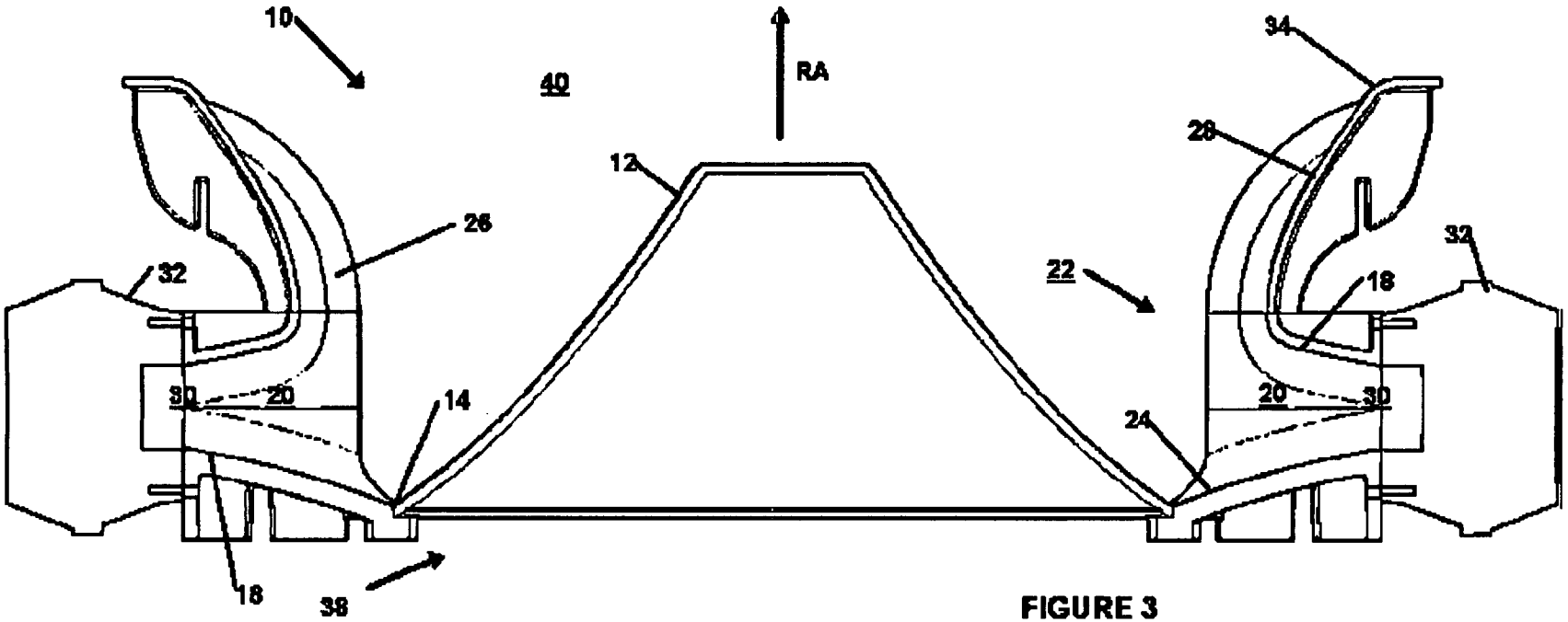
FIG. 3 is a cross sectional view taken along section lines 3-3 of FIG. 1.
Figure 4:
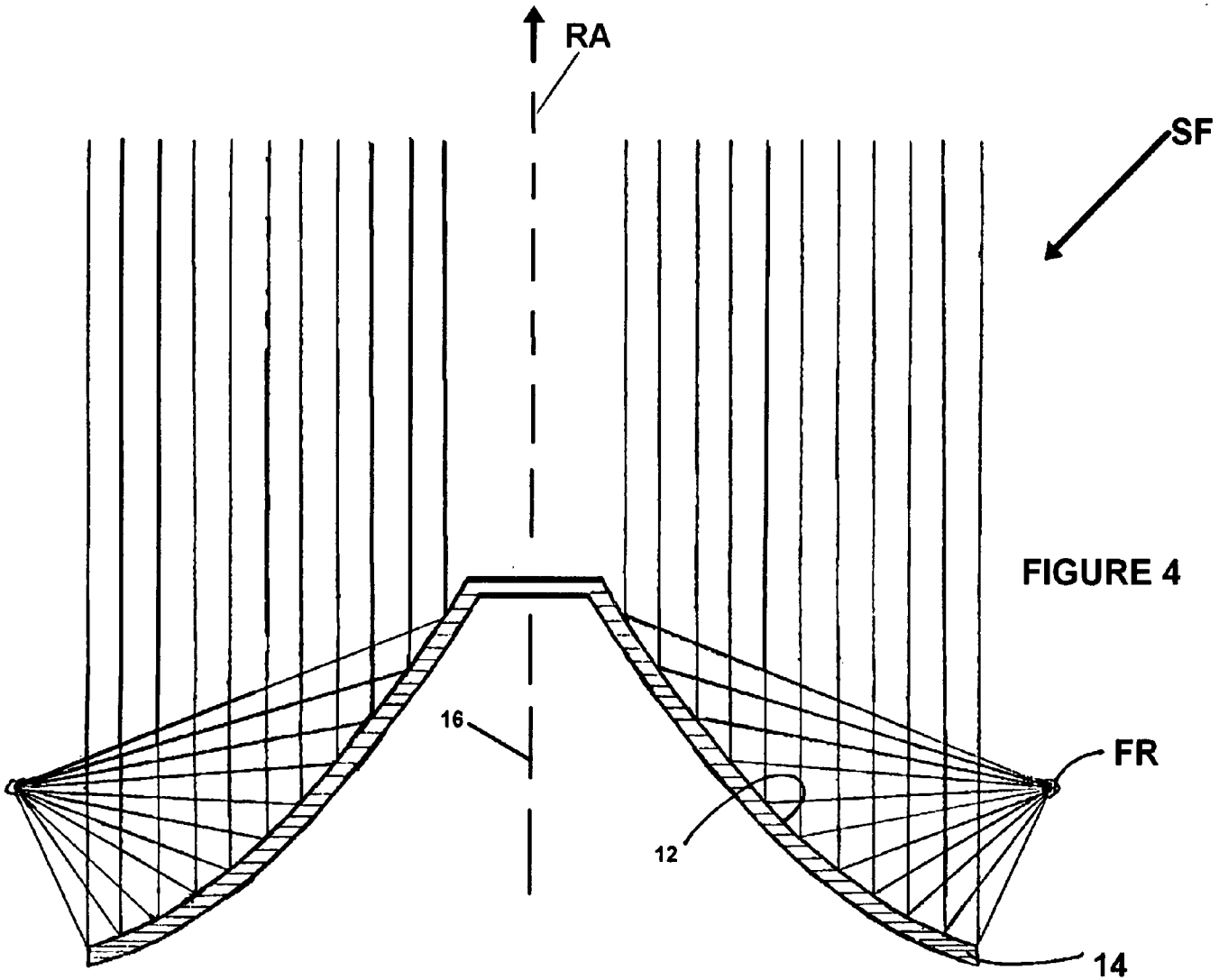
FIG. 4 is a cross sectional view illustrating one aspect of operation of the sound projector.

Referring to the Figures and in particular to FIGS. 1-3, an embodiment of a sound projector 10 is illustrated. A sound projector 10 projects a sound field forward along a radiant axis RA. Sound projector 10 incorporates a cone reflector 12 mounted within a radial array 36 of middle frequency mouths 20. Radial array 36 of middle frequency mouths 20 has a toroidal shape and the middle frequency mouths 20 radiate sound inwardly on the center of the toroid and into cone reflector 12 for reflection forward along the radiant axis RA. The forward direction of the radiant axis RA is indicated by an arrow. Cone reflector 12 is illustrated as a truncated rather than full cone. The sides of cone reflector 12 may have a parabolic cross section for collimating middle and high frequency sound and directing the sound forward along the radiant axis RA which is usually aligned on the central axis 16 of the cone reflector 12.

Sound projector 10 can be used to project a broad frequency spectrum produced by a plurality of drivers 32. Each of drivers 32 is loaded by one of a plurality of horns 18. Horns 18 are shaped to locate the middle frequency mouths 20 in the radial array 36. The length of the horns 18 from the throats 30 to the middle frequency mouths 20 is selected so that the horns 18 provide most of the possible gain for high and middle frequencies. For a conveniently sized acoustic projector middle and high frequency sound would acoustic frequencies above 300 Hz. However, what constitutes the border between low and middle frequencies depends on how large a sound projector 10 can be tolerated. It is conceivable to build a device large enough that low frequency sound would be confined to infra-sound. The middle and high frequencies radiate inwardly from the middle frequency mouths 20 onto cone reflector 12. The center point of middle frequency mouths 20 should fall on a focal ring FR for cone reflector 12. The focal ring FR defines equivalent input points for sources of sound directed into cone reflector 12. Middle and high frequency sound emitted from middle frequency mouths 20 is reflected and collimated into a middle and high frequency sound field SF.

Gains for low frequency sound coupling are boosted by multi-section horn extenders 22. Low frequency sound radiated from middle frequency mouths 20 is, for the most part, not reflected by cone reflector 12. Multi-section horn extenders 22 function to redirect low frequency sound so that it is directed forward along radiant axis RA, though it does not gain the full collimating effects of the cone reflector 12. Multi-section horn extenders 22 comprise a first surface 24 extending from middle frequency mouths 20 to base 14 of cone reflector 12, wedges 26 which are roughly triangular blocks radially arranged around the cone reflector 12 with one wedge 26 being positioned between each pair of adjacent middle frequency mouths 20 and reverse flare sections 28 which extend forward along the radiant axis from the middle frequency mouths 20 and slope away from the radiant axis RA. Cone reflector 12 itself may be considered to be one of the multi-section horn extender 22, but one which is common to all of the plurality of horns 18 in the radial array 36. The base 14 of cone reflector 12 and the first surfaces 24 for each horn 18 form a closed major side 38 opposite the opening 40 from the sound projector 10.

Taken together, the reverse flare sections 28 are referred to as a bell 34 and together define opening 40. From middle frequency mouths 20 through to opening 40 the effective cross-sectional area of a zone defined by wedges 26, reverse flare sections 28, first surfaces 24 and the adjacent portion of cone reflector 12 continue the flare rate for the main body of horns 18 between throats 30 and middle frequency mouths 20. The boundary defined by wedges 26 may be considered as extending into the cone reflectors by the air pressure generated from adjacent horns 18. Alternatively, the middle frequency mouths 20 may be considered as throats for low frequency sound into a second horn formed by bell 34 which may have the same flare rate and flare type as horns 18.

Figure 5:
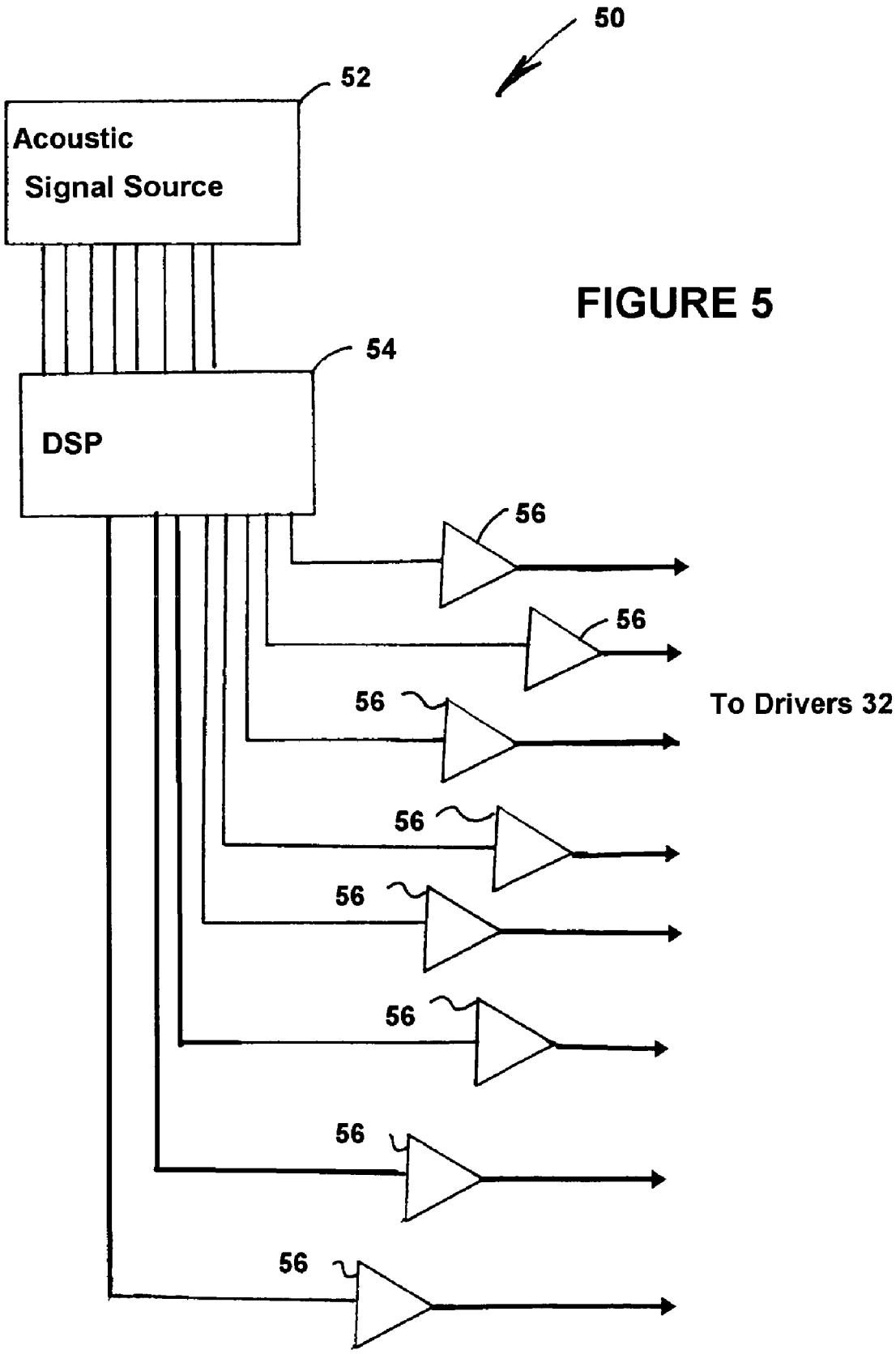
FIG. 5 is a block diagram of a drive signal circuit.

FIG. 5 is a representative drive signal circuit 50 which could be used for exciting drivers 32. The particulars of the illustrated circuit are conventional with an acoustic signal source 52 providing signals for application to the drivers 32 to a digital signal processing unit 54, which may be used for phase or gain control, and then to amplifier stages 56 which boost the signal for application to however many drivers 32 are used.

What is claimed is:

1. A sound projector comprising:

a cone reflector having a base and a central axis aligned on a radiant axis;

a plurality of horns having middle frequency mouths, the middle frequency mouths being disposed radially around the cone reflector forward from the base of the cone reflector along the intended radiant axis with the middle frequency mouths oriented to direct sound energy toward the cone reflector;

the cone reflector being shaped to cooperate with the middle frequency mouths for reflection of sound energy forward along the radiant axis; and multi-part low frequency horn extenders located at each middle frequency mouth, the multi-part low frequency horn extenders including a first surface extending from along a portion of the middle frequency mouth to the base of the cone reflector, wedges positioned between each middle frequency mouth and oriented radially around the intended radiant axis and a reverse flare section extending from along a portion of the middle frequency mouth furthest forward along the intended radiant axis and folded away from the radiant axis.

2. The sound projector of claim 1, further comprising:

each horn having a throat; and a plurality of acoustic transducers coupled to the throats.

3. A sound field blending and projection apparatus comprising:

a plurality of acoustic transducers;

a plurality of horns coupled to the plurality of acoustic transducers;

a plurality of first radiating areas from the plurality of horns, for middle and upper frequencies, the first radiating areas being for the middle and upper frequencies and further being radially arranged with the first radiating surfaces being inwardly oriented;

a cone reflector centered within the radiating areas, the cone reflector being shaped to cooperate with the first radiating areas to reflect middle and high frequency sound radiated from the first radiating surfaces in a forward direction of propagation substantially parallel to a radiant axis; and a bell encircling the conical reflecting surface forward along the projection axis from the arc arrangement of the first radiating areas the bell flaring radially outwardly from the radiant axis.

4. The sound field blending and projection apparatus of claim 3, further comprising:

a plurality of wedges located between and partially defining the first radiating areas from the horns with the wedges being radially aligned on the radiant axis and spaced from the cone reflector.

5. The sound field blending and projection apparatus of claim 4, further comprising:

the bell comprising a plurality of reverse flare sections located between the wedges an extending forward and away from the radiant axis.

6. A sound field blending and projection apparatus comprising:

a plurality of horns with mouths, the mouths being radially arrayed and directed inwardly on one another in a toroid; and a wedge disposed radially between each adjacent pair of mouths;

a closed major side to the toroid; and an opening from the apparatus opposite the closed major side defined by a bell.

7. The sound field blending and projection apparatus of claim 6, further comprising:

a cone reflector having a central axis centered in the toroid to reflect sound radiated from the mouths through the bell.

8. The sound field blending and projection apparatus of claim 7, further comprising:

the horns having throats; and an acoustic driver coupled to each throat.

* * * * *